US006186640B1

(12) United States Patent
Typaldos

(10) Patent No.: US 6,186,640 B1
(45) Date of Patent: Feb. 13, 2001

(54) CIRCUMFERENTIAL BELLOWS PURSE WITH INTERNAL LIGHT

(76) Inventor: Melina Typaldos, P.O. Box 6-3558, El Dorado (PA)

( * ) Notice: Under 35 U.S.C. 154(b), the term of this patent shall be extended for 0 days.

(21) Appl. No.: 09/250,339

(22) Filed: Feb. 16, 1999

(51) Int. Cl.[7] ..... A45C 15/06

(52) U.S. Cl. ..... 362/156; 362/154; 362/155; 362/102; 150/124; 150/118; 150/130; 135/133; 135/136

(58) Field of Search ..... 362/154, 155, 362/156, 102, 295; 150/120, 121, 122, 124, 106, 118, 127, 130; 135/132, 133, 135, 136, 4 R; 240/6.45 P

(56) References Cited

U.S. PATENT DOCUMENTS 3,800,134 * 3/1974 Castaldo ..... 240/6.45 P
4,106,520 * 8/1978 Warner et al. ..... 135/4 R
5,018,057 * 5/1991 Biggs et al. ..... 362/295

* cited by examiner

*Primary Examiner*—Sandra O'Shea
*Assistant Examiner*—Bertrand Zeade
(74) *Attorney, Agent, or Firm*—Frank L. Kubler

(57) ABSTRACT

A hand bag includes an axle structure; several arched support ribs each having a first rib end and a second rib end and being rotatably mounted at the first and second rib ends to the axle structure and bowing outwardly between the first and second rib ends; and flexible sheet material laterally interconnecting the support ribs, so that the sheet material folds and unfolds in accordion fashion as the ribs rotate about the axle structure, the flexible sheet material having an opening defining a hand bag access opening. The several of support ribs preferably include two immediately adjacent opening ribs which are not interconnected by the sheet material, so that rotating the opening ribs about the axle structure away from each other defines between the opening ribs the hand bag access opening. The hand bag preferably additionally includes a hand bag internal lighting assembly. The hand bag internal lighting assembly preferably includes a light source within the hand bag and circuitry for automatically activating the light source upon opening the hand bag access opening and for automatically deactivating the light source upon closing the hand bag access opening.

22 Claims, 3 Drawing Sheets

FIG. 4
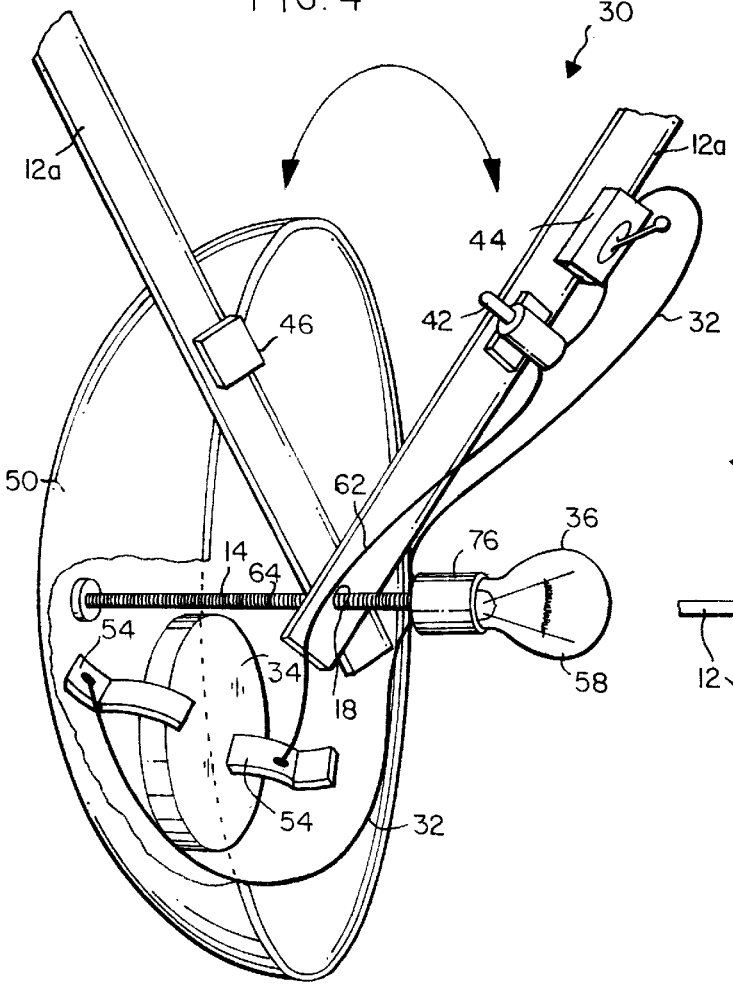
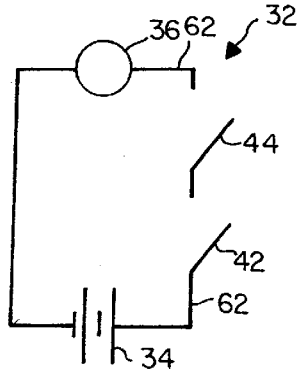
FIG. 5
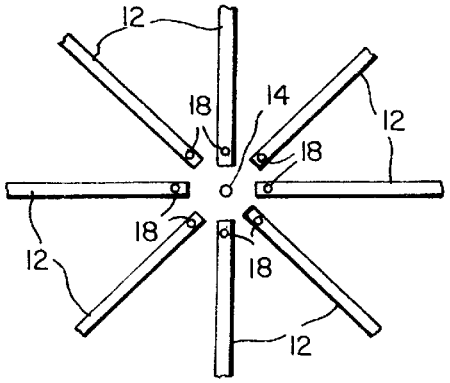
FIG. 6
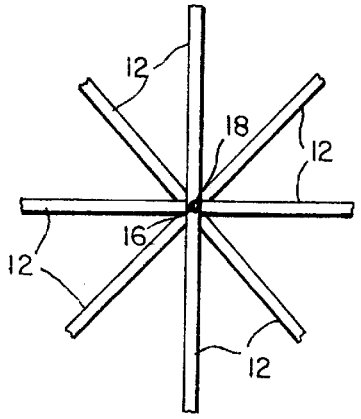
FIG. 7

CIRCUMFERENTIAL BELLOWS PURSE WITH INTERNAL LIGHT

BACKGROUND OF THE INVENTION

1. Field of the Invention

The present invention relates generally to the field of fashion apparel and accessories, and particularly to hand bags. More specifically the present invention relates to a hand bag such as a purse having an automatic internal light assembly and which is configured as circumferentially sequenced, radial bellows constructed of a series of arched support ribs rotatably mounted at each end to co-linear and longitudinally spaced apart half axles and interconnected by flexible sheet material. The sheet material expands and folds with the ribs in accordion fashion as the ribs rotate about the axles. Ends of the sheet material are secured to adjacent ribs which together define a hand bag access opening. A lighting circuit is housed within concave axle head structures secured to outer ends of each half axle at end of the hand bag.

2. Description of the Prior Art

There have long been purses and other hand bags for carrying personal items on errands and excursions. A problem with most purses, and hand bags generally, has been that they tend to be monotonously uniform in structure and appearance, and most lack internal lighting so that items they contain are difficult to locate while one is outdoors at night.

It is thus an object of the present invention to provide a hand bag which is new and is noticeably different in mechanical structure and appearance from those already known.

It is another object of the present invention to provide such a hand bag which has a structure which causes an interesting and inter-dependent movement of virtually all portions of the hand bag when the hand bag is opened or closed.

It is still another object of the present invention to provide such a hand bag which contains lighting means which automatically activates when the hand bag is opened and deactivates when it is closed, and in which the lighting means are largely contained within and integrated with the hand bag structural and ornamental features.

It is finally an object of the present invention to provide such a hand bag which is durable, spacious and relatively inexpensive to manufacture.

SUMMARY OF THE INVENTION

The present invention accomplishes the above-stated objectives, as well as others, as may be determined by a fair reading and interpretation of the entire specification.

A hand bag is provided, including an axle structure; several arched support ribs each having a first rib end and a second rib end and being rotatably mounted at the first and second rib ends to the axle structure and bowing outwardly between the first and second rib ends; and flexible sheet material laterally interconnecting the support ribs, so that the sheet material folds and unfolds in accordion fashion as the ribs rotate about the axle structure, the flexible sheet material having an opening defining a hand bag access opening.

The several of support ribs preferably include two immediately adjacent opening ribs which are not interconnected by the sheet material, so that rotating the opening ribs about the axle structure away from each other defines between the opening ribs the hand bag access opening. The hand bag preferably additionally includes a hand bag internal lighting assembly. The hand bag internal lighting assembly preferably includes a light source within the hand bag and circuitry for automatically activating the light source upon opening the hand bag access opening and for automatically deactivating the light source upon closing the hand bag access opening. The axle structure preferably includes substantially co-linear and longitudinally spaced apart first and second half axles, each of the half axles having an axle outwardly directed end and an axle inwardly directed end.

The hand bag internal lighting assembly preferably includes a light circuit including the light source, a power source and an automatic light switch secured to one of the opening ribs and oriented so that pivoting the opening ribs together to close the access opening causes a portion of the hand bag to bear against and thus actuate the automatic switch to open the circuit and thereby deactivate the light source, and separating and pivoting apart the opening ribs to open the hand bag access opening causes the portion of the hand bag to move out of contact with the automatic switch and thereby causes the automatic switch to close the circuit and activate the light source. The sheet material has an outer surface and the hand bag preferably additionally includes a head structure secured to at least one of the outwardly directed ends of the half axles and extending over the outer surface of the sheet material and the ribs, the head structure being concave and opening toward the interior of the hand bag to define a concave region within the head structure; where the power source is contained within the concave region.

The light source preferably is mounted to the inward end of at least one of the half axles. The at least one half axle optionally is tubular and has a lateral entrance port and a wire of the circuit extends through the at least one half axle to the light source to deliver electrical power to the light source. The circuit preferably additionally includes a manual switch for opening the circuit and preventing activation of the light source regardless of the activation status of the automatic switch. The hand bag preferably includes one of the head structure and one of the circuits and at each of the half axle outwardly directed ends.

The ribs preferably are metal slats bowed to retain their arch shape and having axle ports at each rib end which are fitted over corresponding half axles. Each of the head structures preferably has a head structure outer face which includes ornamental design elements.

The light source preferably includes a light bulb socket and a light bulb, and the at least one half axle preferably includes external threads and in this instance the socket includes an axle receiving bore having corresponding internal threads for receiving and removably engaging the at least one half axle.

The hand bag preferably additionally includes a handle for carrying the hand bag, the handle being substantially U-shaped with two handle ends, each of the handle ends being secured to one of the support ribs. The handle preferably includes telescoping elements so that the handle is extendable into a longer mode and retractable into a shorter mode.

The sheet material preferably is secured to support rib surfaces directed toward the interior of the hand bag with sheet material fasteners. The sheet material has a sheet material outward surface directed away from the interior of the hand bag and a sheet material inward surface directed toward the interior of the hand bag and the sheet material inward surface optionally is secured to rib surfaces; the hand bag additionally including rib cover strips secured to the outward surface of the sheet material adjacent to and along the ribs, sandwiching the sheet material between the ribs and the rib cover strips, to create the appearance of exposed ribs.

A hand bag is further provided, including an axle structure; at least three arched support ribs each having a first rib end and a second rib end and being rotatably mounted at the first and second rib ends to the axle structure and bowing outwardly between the first and second rib ends; flexible sheet material laterally interconnecting the support ribs, so that the sheet material folds and unfolds in accordion fashion as the ribs rotate about the axle structure, the flexible sheet material having an opening defining a hand bag access opening; and a hand bag internal lighting assembly. The at least three arched support ribs preferably include two immediately adjacent opening ribs which are not interconnected by the sheet material, so that rotating the opening ribs about the axle structure away from each other defines between the opening ribs the hand bag access opening.

BRIEF DESCRIPTION OF THE DRAWINGS

Various other objects, advantages, and features of the invention will become apparent to those skilled in the art from the following discussion taken in conjunction with the following drawings, in which:

FIG. 4 is a perspective, close-up view of one of the half axles and lighting assemblies, with only the two opening ribs shown, with a portion of the head structure cut away to reveal portions of the lighting circuit.

FIG. 5 is a schematic view of the lighting circuit, including the automatic and manual switches.

FIG. 6 is an exploded view ends of the ribs and one of the half axles, showing the axle ports in the ribs for fitting over the half axle.

FIG. 7 is a view as in FIG. 6 with the ribs shown mounted on the half axle.

DETAILED DESCRIPTION OF THE PREFERRED EMBODIMENTS

Figure 1:
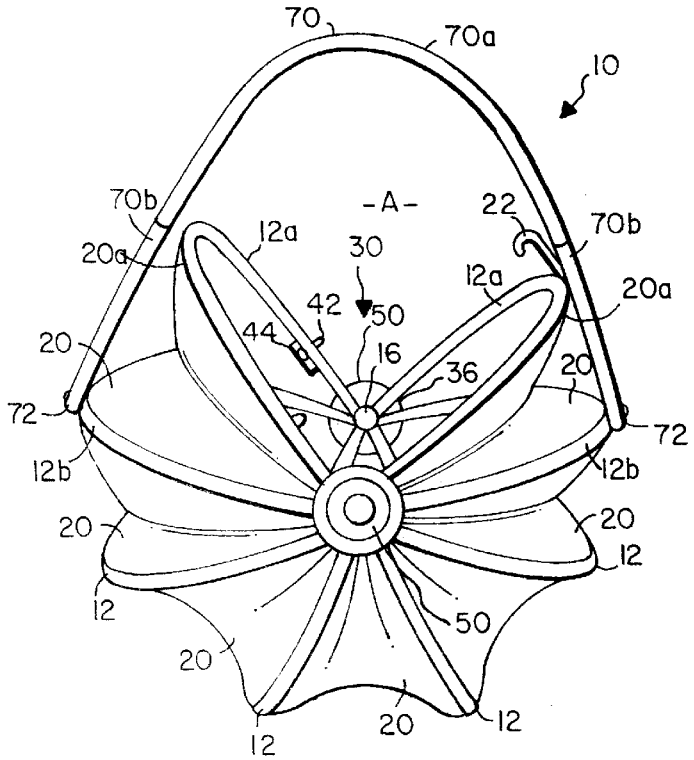
FIG. 1 is a front perspective view of the preferred embodiment of the hand bag, shown with the telescoping handle in its retracted mode and the hand bag open and revealing parts of the lighting assemblies.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 3:
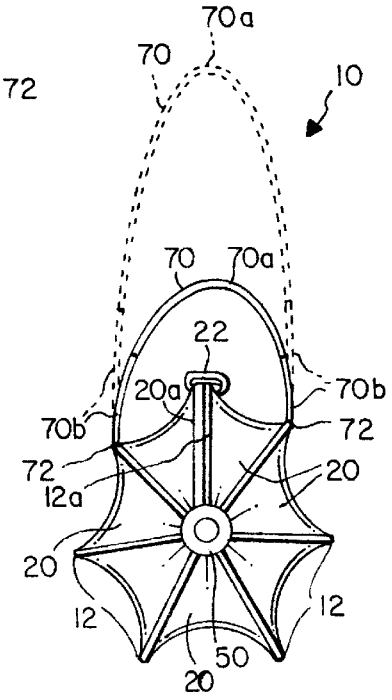
FIG. 3 is a view as in FIG. 1, except that the hand bag is shown closed and the handle is shown in its extended mode in broken lines. The hook structure is shown engaging the opposing opening rib to hold the hand bag removably closed.
Figure 2:
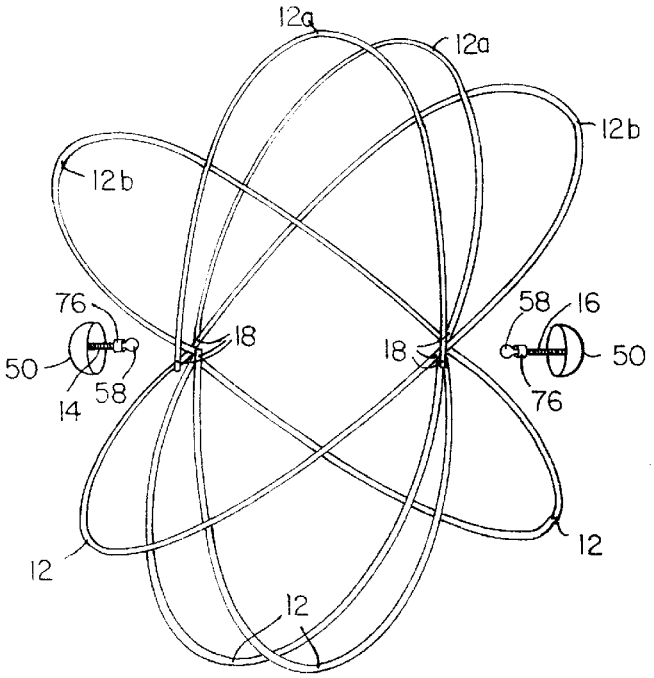
FIG. 2 is an exploded view of the ribs and of the half axles with the half axle head structures and lighting assemblies attached.
Figure 8:
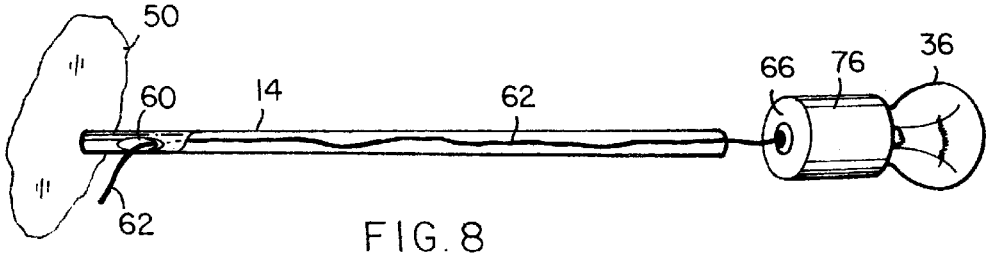
FIG. 8 is cross-sectional side view of one of the tubular half axles showing the power wire running through the half axle to the socket, and showing threaded bore in the socket for mounting the socket onto the half axle.
Figure 9:
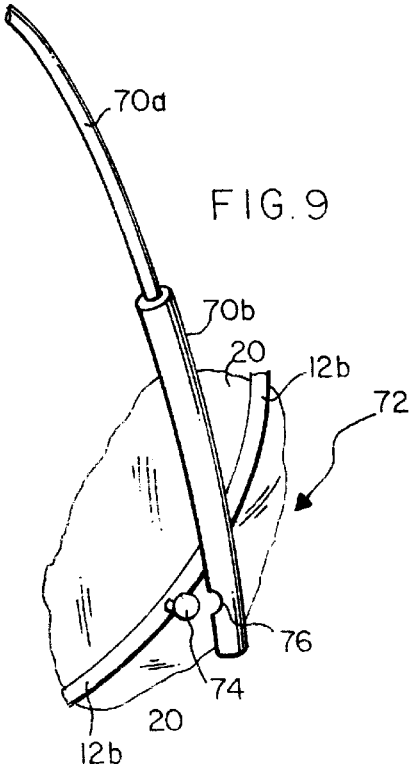
FIG. 9 is a broken away close up view of an end of the ball and socket for mounting an end of the telescoping handle onto one of the opening ribs.
Figure 10:
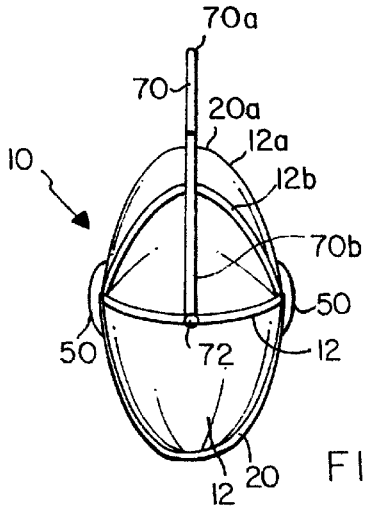
FIG. 10 is a side view of the hand bag of FIG. 1, showing the telescoping handle retracted.
Figure 11:
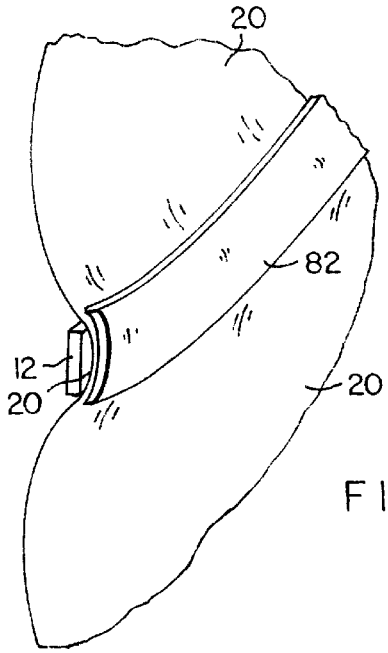
FIG. 11 is a broken away perspective view of one of the ribs extending along the inside surface of the sheet material and a rib cover strip fitted over the sheet material outside surface along and over the rib.

Referring to FIGS. 1–11, a hand bag 10 is disclosed which is configured as a circumferentially sequenced, radial bellows constructed of a series of arched support ribs 12 rotatably mounted at each end to co-linear and longitudinally spaced apart half axles 14 and 16 and laterally interconnected by flexible sheet material 20 which folds and unfolds in accordion fashion as the ribs 12 rotate about half axles 14 and 16. See FIGS. 1 and 2. A hand bag internal lighting assembly 30 is provided which automatically illuminates the hand bag 10 interior when the hand bag 10 is opened and which automatically deactivates when hand bag 10 is closed.

Sheet material 20 has opposing sheet material ends 20*a* at each of two adjacent ribs 12, hereinafter referred to as opening ribs 12*a*. Immediately adjacent to each opening rib 12*a* is what will be referred to as a secondary rib 12*b*. Ribs 12*a* and sheet material ends 20*a* together define a hand bag access opening A between the two opening ribs 12*a*, which opens as opening ribs 12*a* are manually rotated about half axles 14 and 16 away from each other and closes as opening ribs 12*a* are manually rotated toward each other. The remaining ribs rotate to some extent about half axles 14 and 16 as opening ribs 12*a* are rotated, as a result of the sheet material 10 interconnection of the ribs. This overall movement of hand bag ribs 12 and sheet material 20 portions between ribs 12 during hand bag 10 opening and closing is an important component and feature of the invention, creating an animated visual appeal. A hook structure 22 preferably is pivotally secured to one of the opening ribs 12*a* and pivots over and releasibly engages the opposing opening rib 12*a* to secure opening ribs 12*a* abuttingly together and thereby to hold access opening A closed. See FIGS. 1 and 2.

Internal lighting assembly 30 includes a light circuit 32, a power source 34 and a light source 36. See FIGS. 4 and 5. Light circuit 32 includes an automatic light switch 42 secured to one of the two opening ribs 12*a* and oriented so that pivoting the opening ribs 12*a* together to close the access opening A causes the opposing rib 12*a* or a stop structure 46 secured to opposing rib 12*a* to bear against and thus actuate the switch 42 to open the circuit 32 and deactivate the light source 34, and separating and pivoting apart the two opening ribs 12*a* to open hand bag 10 causes the opposing rib 12*a* to move out of contact with and causes switch 42 to close the circuit 32 and activate the light source 34. Light source 34 is preferably located at the inward end of the half axle 14 or 16 nearest the switch 42. A manual switch 44 is preferably provided in circuit 32 to open the circuit and thus prevent light source 34 activation altogether for a selected time interval, so that hand bag 10 may be opened in such places as movie theaters where light would be undesirable. A separate internal lighting assembly 30 is preferably provided at each half axle 14 or 16.

Ribs 12, 12*a* and 12*b* are preferably metal slats bowed to retain the desired arch shape and having axle ports 18 at each end which are fitted over the corresponding half axles 14 and 16. See FIGS. 2, 6 and 7. A concave head structure 50 is secured to the outward end of each half axle 14 and 16 such as by welding and extends outside the sheet material 20 covering and outside the rib ends to be fully visible outside hand bag 10, and opens toward the hand bag 10 interior. The outer face of each concave head structure 50 preferably is configured to create an ornamental appearance such as that of a medallion.

Light circuit 32 and power source 34 are preferably located within the concave head structure 50 interior region. See FIG. 4. The power source 34, preferably in the form of a watch battery, is removably secured within the head structure 50 interior region by resilient terminal clips 54 secured to and electrically insulated from the head structure 50. Lighting circuit 30 wiring extends from within the concave head structure 50 along the adjacent half axle 14 or 16 to the light source 36, which preferably includes a light bulb socket 56 and a light bulb 58 fitted into socket 56. The half axle 14 or 16 is optionally tubular, and has a wire entrance port 60 near its outward end and a positive circuit wire 62 extends through the half axle to the light socket 56, such that wire 62 is concealed within the half axle. See FIG. 8. The half axle 14 or 16 preferably additionally serves as an electrical ground for socket 56. The half axle 14 or 16 optionally includes external threads 64 and socket 56 includes a correspondingly internally threaded bore 66 opposite its bulb 58 receiving end and socket 56 is removably screwed onto the half axle 14 or 16 protruding end.

A handle 70 is preferably provided and takes the form of a bowed metal structure rotatably and pivotally secured to substantially opposing ribs 12, at the rib mid-portions, with ball joints 72, so that the handle 70 can rotate a full orbit around the remainder of hand bag 10. See FIG. 9. Handle 70 is preferably formed of telescoping segments so that handle 70 can be made short to carry the hand bag 10 in the user hand and alternatively made long to fit over a user shoulder. See FIGS. 3 and 10. The telescoping segments include an arched, flexible center segment 70*a* and two tubular base segments 70*b*, each base segment 70*b* being pivotally connected to one of the secondary ribs 12*b* and sized to slidingly receive one of the ends of center segment 70*a*. The ball joints 72 each include a ball 74 secured to the given opening rib 12*a* and a socket 76 recessed into the adjacent handle base segment. See FIG. 9.

The flexible sheet material 20 may be secured to the ribs 12, 12*a* and 12*b* in a variety of different ways, and is preferably formed of a light leather or linen composition. It is preferred for aesthetic purposes that outwardly directed rib surfaces be exposed, and have bright metallic or burnt metal colors contrasting with the sheet material 20 coloring. A preferred way to accomplish this is to connect a continuous length of the sheet material 20 to the rib surfaces directed toward the interior of the hand bag 10 with a durable glue or other well known fastening means. Alternatively, sheet material 20 may be stretched and glued over the outwardly directed rib surfaces, and laterally arched rib cover strips 82 may be glued to the material 20 over the rib locations, sandwiching the material 20 between the ribs and rib cover strips 82, to create the appearance of exposed ribs. See FIG. 11.

It is preferred that the position of secondary ribs 12*b*, to which handle base segments 70*b* are pivotally connected, is closer to the top of hand bag 10 where opening A is located than to the bottom of hand bag 10. This construction distributes more of the weight of hand bag 10 below the handle ball joints 72 than above them so that the hand bag 10 automatically rights itself after rotatably swinging about ball joints 72 during hand bag 10 carrying. Absent this construction, or in addition to it, it is contemplated that ballast elements (not shown) may be secured within the hand bag 10 lower end to cause hand bag 10 self-righting.

It is understood that hand bag 10 may function as a purse, or as any other type of hand carried vessel such as a stylized brief case or overnight kit. Many types and colors of flexible material may be provided, and the ribs 12, 12*a* and 12*b* and head structures 50 may be formed of any suitable metal, plastic, wood or other material and have any color desired for aesthetic reasons.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A hand bag, comprising:

axle means;

a plurality of arched support ribs each having a first rib end and a second rib end and being rotatably mounted at said first and second rib ends to said axle means and bowing outwardly between said first and second rib ends;

flexible sheet material laterally interconnecting said support ribs which folds and unfolds in accordion fashion as said support ribs rotate about said axle means, said flexible sheet material having an opening defining a hand bag access opening, said plurality of support ribs being collapsed toward each other when said access opening is open and thus when said hand bag is open, and said plurality of support ribs being spread away from each other to define substantially a sphere when said access opening is closed and thus when said hand bag is closed;

and handle means for carrying said hand bag.

2. The hand bag of claim 1, wherein said plurality of support ribs comprise two immediately adjacent opening ribs which are not interconnected by said sheet material, such that rotating said opening ribs about said axle means away from each other defines between said opening ribs said hand bag access opening.

3. The hand bag of claim 2, additionally comprising hand bag internal lighting means.

4. The hand bag of claim 3, wherein said hand bag internal lighting means comprises a light source within said hand bag and means for automatically activating said light source upon opening said hand bag access opening and for automatically deactivating said light source upon closing said hand bag access opening.

5. The hand bag of claim 4, wherein said axle means comprises:

substantially co-linear and longitudinally spaced apart first and second half axles, each said half axle having an axle outwardly directed end and an axle inwardly directed end.

6. The hand bag of claim 5, wherein said hand bag internal lighting means comprises:

a light circuit comprising said light source, a power source and an automatic light switch secured to one said opening rib and oriented such that pivoting said opening ribs together to close said access opening causes a portion of said hand bag to bear against and thus actuate said automatic switch to open said circuit and thereby deactivate said light source, and separating and pivoting apart said opening ribs to open said hand bag access opening causes said portion of said hand bag to move out of contact with said automatic switch and thereby causes said automatic switch to close said circuit and activate said light source.

7. The hand bag of claim 6, wherein said sheet material has an outer surface, additionally comprising a head structure secured to at least one said outwardly directed end of said half axles and extending over the outer surface of said sheet material and said ribs, said head structure being concave and opening toward the interior of said hand bag to define a concave region within said head structure;

wherein said power source is contained within said concave region.

8. The hand bag of claim 7, wherein said light source is mounted to the inward end of at least one said half axle.

9. The hand bag of claim 8, wherein said at least one half axle is tubular and has a lateral entrance port and wherein a wire of said circuit extends through said at least one half axle to said light source to deliver electrical power to said light source.

10. The hand bag of claim 6, wherein said circuit additionally comprises a manual switch for opening said circuit and preventing activation of said light source regardless of the activation status of said automatic switch.

11. The hand bag of claim 7, comprising one said head structure at each said half axle outwardly directed end.

12. The hand bag of claim 11, wherein said ribs are metal slats bowed to retain said arch shape and having axle ports at each rib end which are fitted over corresponding said half axles.

13. The hand bag of claim 7, wherein each said head structure has a head structure outer face which includes ornamental design elements.

14. The hand bag of claim 9, wherein said light source comprises a light bulb socket and a light bulb, and wherein said at least one half axle comprises external threads and wherein said socket comprises an axle receiving bore having corresponding internal threads for receiving and removably engaging said at least one half axle.

15. The hand bag of claim 1, wherein said handle means comprises a handle for carrying said hand bag, said handle being substantially U-shaped with two handle ends, each said handle end being secured to one of said support ribs.

16. The hand bag of claim 15, wherein said handle comprises telescoping elements such that said handle is extendable into a longer mode and retractable into a shorter mode.

17. The hand bag of claim 1, wherein said sheet material is secured to support rib surfaces directed toward the interior of said hand bag with sheet material fastening means.

18. The hand bag of claim 1, wherein said sheet material has a sheet material outward surface directed away from the interior of said hand bag and a sheet material inward surface directed toward the interior of said hand bag and wherein said sheet material inward surface is secured to rib surfaces;

said hand bag additionally comprising rib cover strips secured to the outward surface of said sheet material adjacent to and along said ribs, sandwiching said sheet material between said ribs and said rib cover strips, to create the appearance of exposed ribs.

19. A hand bag, comprising:

axle means;

at least three arched support ribs each having a first rib end and a second rib end and being rotatably mounted at said first and second rib ends to said axle means and bowing outwardly between said first and second rib ends;

flexible sheet material laterally interconnecting said support ribs which folds and unfolds in accordion fashion as said support ribs rotate about said axle means, said flexible sheet material having an opening defining a hand bag access opening, said at least three support ribs being collapsed toward each other when said access opening is open and thus when said hand bag is open, and said at least three support ribs being spread away from each other to define substantially a sphere when said access opening is closed and thus when said hand bag is closed;

handle means for carrying said hand bag;

and hand bag internal lighting means.

20. The hand bag of claim 19, wherein said at least three arched support ribs comprise two immediately adjacent opening ribs which are not interconnected by said sheet material, such that rotating said opening ribs about said axle means away from each other defines between said opening ribs said hand bag access opening.

21. A hand bag, comprising:

axle means;

at least five arched support ribs each having a first rib end and a second rib end and being rotatably mounted at said first rib end and said second rib end to said axle means and bowing outwardly between said first rib end and said second rib end;

flexible sheet material laterally interconnecting said support ribs which folds and unfolds in accordion fashion as said ribs rotate about said axle means, said at least five arched support ribs comprising two immediately adjacent opening ribs between which is located an opening in said flexible sheet material defining a hand bag access opening, said opening ribs being spaced apart from each other, and the remaining said at least five support ribs being collapsed toward each other, when said access opening is open and thus when said hand bag is open, and said opening ribs being in substantial lateral abutment with each other, and the remaining said at least five support ribs being spread away from each other to define substantially a spheroid, when said access opening is closed and thus when said hand bag is closed;

and handle means for carrying said hand bag.

22. A hand bag, comprising:

axle means;

at least five arched support ribs each having a first rib end and a second rib end and being rotatably mounted at said first rib end and said second rib end to said axle means and bowing outwardly between said first rib end and said second rib end;

flexible sheet material laterally interconnecting said support ribs which folds and unfolds in accordion fashion as said ribs rotate about said axle means, said at least five arched support ribs comprising two immediately adjacent opening ribs between which is located an opening in said flexible sheet material defining a hand bag access opening, said opening ribs being spaced apart from each other, and the remaining said at least five support ribs being collapsed toward each other, when said access opening is open and thus when said hand bag is open, and said opening ribs being in substantial lateral abutment with each other, and the remaining said at least five support ribs being spread away from each other to define substantially a spheroid, when said access opening is closed and thus when said hand bag is closed;

handle means for carrying said hand bag;

and hand bag internal lighting means comprising a light source within said hand bag and means for automatically activating said light source upon opening said hand bag access opening and for automatically deactivating said light source upon closing said hand bag access opening;

wherein said hand bag internal lighting means comprises a light circuit comprising said light source, a power source and an automatic light switch secured to one said opening rib and oriented such that pivoting said opening ribs together to close said access opening causes a portion of said hand bag to bear against and thus actuate said automatic switch and thereby deactivate said light source, and separating and pivoting apart said opening ribs to open said hand bag access opening causes said portion of said hand bag to move out of contact with said automatic switch and thereby causes said automatic switch to close said circuit and activate said light source;

wherein said axle means comprises substantially co-linear and longitudinally spaced apart first and second half axles, each said half axle having an axle outwardly directed end and an axle inwardly directed end, comprising one said head structure on said circuit and at each said half axle outwardly directed end, each said head structure having a head structure outer face which includes ornamental design elements;

wherein said sheet material has an outer surface, and wherein said at least one head structure extends over the outer surface of said sheet material and said ribs, said head structure being concave and opening toward the interior of said hand bag to define a concave region within said head structure;

and wherein said power source is at least partly contained within said concave region.

* * * * *